US006520361B2

(12) United States Patent
Joulia

(10) Patent No.: US 6,520,361 B2
(45) **Date of Patent: *Feb. 18, 2003**

(54) CLOSURE WITH ELASTICALLY DEFORMED PART AT SCREW THREADS

(75) Inventor: Gerard Joulia, Paris (FR)

(73) Assignee: L'Oreal, Paris (FR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/398,469

(22) Filed: Sep. 17, 1999

(65) Prior Publication Data

US 2002/0033375 A1 Mar. 21, 2002

(30) Foreign Application Priority Data

Sep. 24, 1998 (FR) ..... 9811944

(51) Int. Cl.[7] ..... B65D 41/04

(52) U.S. Cl. ..... 215/329; 215/334; 215/316; 220/288; 220/296; 264/268

(58) Field of Search ..... 215/329, 330, 215/337, 44, 334, 331, 316; 220/288, 289, 290, 300, 296, 294; 264/268

(56) References Cited

U.S. PATENT DOCUMENTS

| | | | | | |
|---|---|---|---|---|---|
| 1,351,496 | A | * | 8/1920 | Spooner | 215/329 |
| 2,168,594 | A | | 8/1939 | Von Till | |
| 2,196,345 | A | * | 4/1940 | Taylor | 215/334 |
| 4,011,962 | A | * | 3/1977 | Favell | 215/334 |
| 4,349,116 | A | * | 9/1982 | Luenser | 220/289 X |
| 4,557,394 | A | | 12/1985 | Luker | |
| 4,732,289 | A | * | 3/1988 | Granat et al. | 215/44 X |
| 4,742,929 | A | | 5/1988 | Desai | |
| 5,197,620 | A | * | 3/1993 | Gregory | 215/307 |
| 5,246,123 | A | * | 9/1993 | Kramer et al. | 215/218 |
| 5,320,233 | A | * | 6/1994 | Welch | 220/330 X |
| 5,348,885 | A | * | 9/1994 | Labarthe | 220/290 X |
| 5,692,628 | A | * | 12/1997 | Montgomery et al. | 220/289 X |
| 5,931,432 | A | * | 8/1999 | Herold et al. | 248/343 |
| 5,975,093 | A | | 11/1999 | Joulia | |

FOREIGN PATENT DOCUMENTS

| | | | | |
|---|---|---|---|---|
| DE | 2153071 | * | 5/1973 | 215/44 |
| EP | 0 622 305 | | 11/1994 | |
| FR | 834 129 | | 11/1938 | |
| FR | 1112358 | * | 4/1956 | 215/334 |
| GB | 1457463 | * | 12/1976 | 220/294 |
| JP | 63-154457 | | 10/1988 | |

* cited by examiner

*Primary Examiner*—Robin Hylton
(74) *Attorney, Agent, or Firm*—Oblon, Spivak, McClelland, Maier & Neustadt, P.C.

(57) ABSTRACT

A closure has a first screw thread (11) capable of cooperating with a second screw thread formed by a container intended to receive the closure. An elastically deformed part (28, 31) is capable, when the first (11) and second screw threads are engaged, of keeping the closure bearing elastically on the container in at least one direction oriented radially with respect to the closure, so as to improve the holding and working of the closure on the container.

22 Claims, 3 Drawing Sheets

CLOSURE WITH ELASTICALLY DEFORMED PART AT SCREW THREADS

BACKGROUND OF THE INVENTION

1. Field of the Invention

The present invention relates to a closure of the threaded closure type, capable of being removably mounted on a container, particularly in the form of a glass jar, a bottle, a pot or some other shape. The invention is specifically suited to the closure of glass jars such as those used for packaging cosmetic care creams.

2. Description of the Related Art

In the field of cosmetics, particularly in the field of care creams, it is relatively commonplace to make use of glass jars. These jars are generally closed by a plastic lid having a screw thread capable of cooperating with a corresponding screw thread provided on an external surface of the jar in the vicinity of an opening delimited by a free edge.

One of the problems encountered with this type of packaging arises due to the large clearance existing between the jar and its plastic cap, which clearance is essentially due to the manufacturing tolerances of the glass screw thread, which are very wide. Such clearance leads to problems with the airtightness and keeping of the cream contained in the jar. Furthermore, it is not very well received by the consumers.

SUMMARY OF THE INVENTION

Thus, one of the objects of the invention is to provide a closure which completely or partially solves the problems discussed above with reference to the conventional devices.

Another object of the invention is to provide a closure, particularly for a glass container, which is able to compensate for the wide manufacturing tolerances on the glass.

It is a further object of the invention to provide a closure which is simple and economical to manufacture, particularly by molding.

According to a first aspect of the invention, these and other objects are achieved by a closure comprising a first screw thread capable of cooperating with a second screw thread defined by a container intended to receive said closure. It includes an elastically deformed part capable, when the first and second screw threads are engaged, of keeping the closure bearing elastically on the container in at least one direction which is oriented radially with respect to the closure, so as to improve the holding of the closure on the container. Thus, these elastically deformed parts make it possible to compensate for the wide tolerances arising in producing the screw thread borne by the container, particularly when this container is a glass container.

Advantageously, the elastically deformed parts are capable, when the first and second screw threads are engaged, of retaining at least one portion of the first screw thread bearing elastically on at least one corresponding portion of the second screw thread. The presence of these elastically deformed parts "locks" the screw thread when the closure is being screwed on and unscrewed. In other words, it is possible to obtain zero or practically zero functional clearance, thus substantially improving the packing qualities.

In a particular embodiment, the closure comprises a lateral skirt bearing the first screw thread, the elastically deformed part consisting of at least one elastically deformed portion of the skirt whose radius of curvature, at rest, differs from the radius of curvature of the remainder of the skirt. In such a configuration, the first screw thread is preferably produced on the interior wall of the lateral skirt, so that it can be engaged with the second screw thread borne by the exterior wall of a neck formed by the container.

Preferably the elastically deformed parts consist of at least one "flat" formed by the skirt. Such a flat may, in the case of a closure which is obtained by molding a thermoplastic, be obtained by deforming the lateral skirt as it leaves the mold and before the material has completely cooled. According to an advantageous alternative, the flat is also obtained directly at the time of molding, by giving the mold the appropriate shape.

Preferably, the closure has two diametrically opposed elastically deformed parts. By achieving such symmetry, the holding of the closure on the container is improved and, in particular, the closure is better centered on the container. The comfort experienced in opening and closing it is thus appreciably improved.

In another specific embodiment, the closure comprises a transverse wall, one edge of which is bent at 90° to form the lateral skirt bearing the first screw thread. Such a structure helps in improving airtightness upon closure.

Preferably, each of the elastically deformed part is delimited at least in part by a slot formed in the lateral skirt in the vicinity of the transverse wall. Thus, each slot is associated with an elastically deformed band. Each of the elastically deformed parts extends along the entire angular width of the corresponding slot, and is delimited by one edge of the slot and by the free edge of the lateral skirt which lies facing the slot.

Also, the lateral skirt preferably comprises at least two diametrically opposed angular portions which have no screw thread. An arrangement of this kind allows for easy mold-release of the closure by allowing a mold made in three parts, namely a central part lying facing the thread-free parts, and two lateral parts. Mold release is achieved by first withdrawing the central part and by then bringing the two lateral parts closer together, so as to allow the threaded parts of the closure to be released from the mold.

In a particularly advantageous embodiment, the closure comprises two slots situated outside of the angular portions which have no screw thread. Advantageously, the two slots are diametrically opposed. Advantageously also, the two slots are centered on an axis substantially perpendicular to an axis on which are centered the two portions which have no screw thread. These two slots can be released from the mold as the two lateral parts of the mold are brought closer together.

In the case of a closure which is obtained by molding, it may be made of a thermoplastic, particularly a polyethylene or a polypropylene.

The closure may be covered with an outer covering whose function is mainly aesthetic, particularly to conceal the slots made in the lateral skirt of the closure. Furthermore, the outer covering makes it possible to increase the rigidity of the structure bearing the screw thread. This covering also allows the use of materials whose aesthetics are particularly well-suited to applications such as the field of cosmetics. The closure may be rendered integral with the outer covering by any appropriate technique, particularly by bonding, welding or snap-fastening.

According to a second aspect of the invention, there is also provided a container comprising a closure according to the first aspect.

Advantageously, the container is made of glass. It may, in particular, be a jar intended for packaging a care cream.

BRIEF DESCRIPTION OF THE DRAWINGS

Apart from the provisions explained hereinabove, the invention consists in a certain number of other provisions which will be explained hereafter with regard to non-limiting embodiments which are described with reference to the appended Figures, among which.

DETAILED DESCRIPTION OF THE PREFERRED EMBODIMENTS

Figure 1:
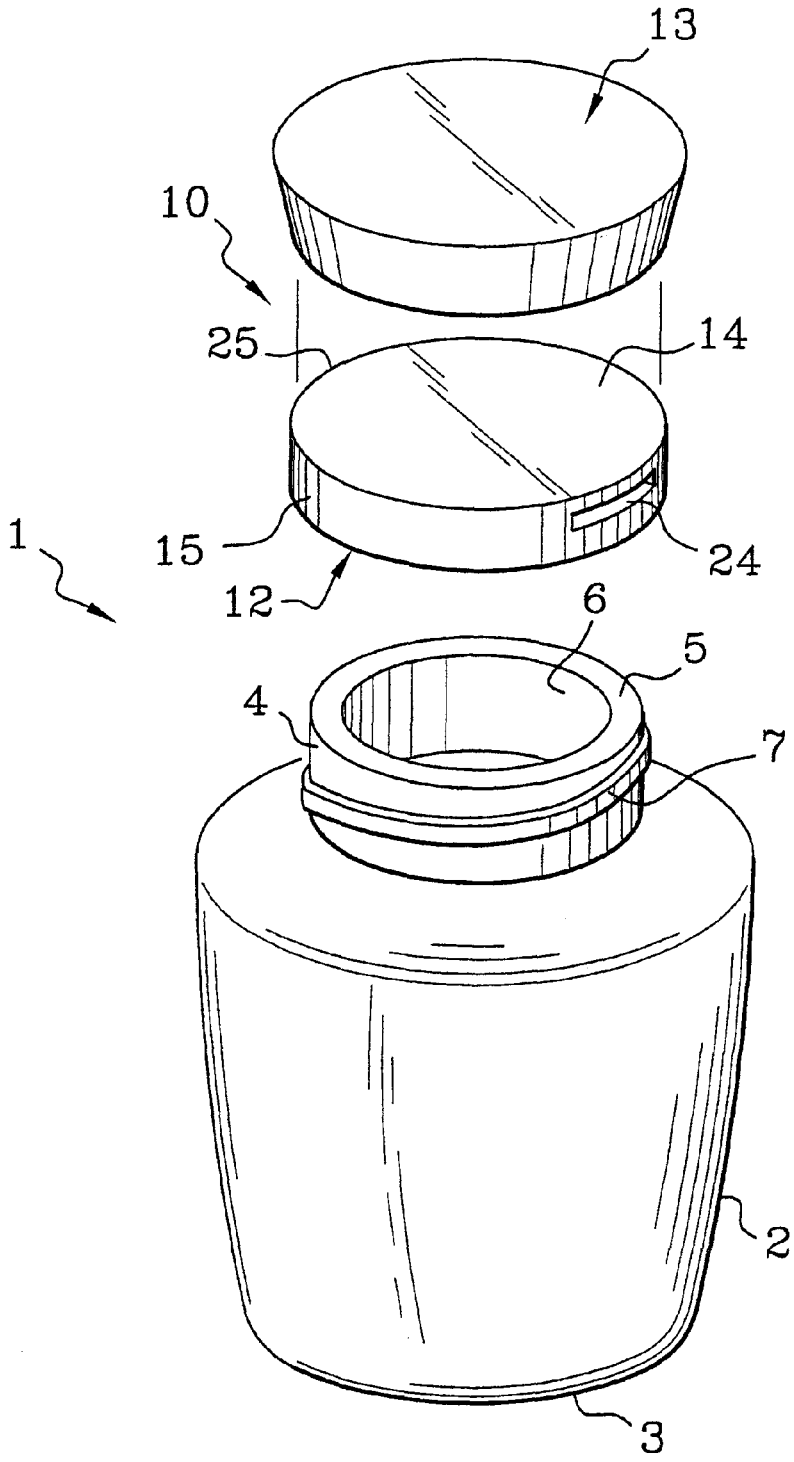
FIG. 1 depicts a general arrangement of a glass container equipped with a closure according to the invention.

The container 1 depicted in FIG. 1 comprises a body 2, one end of which is closed by an end wall 3 and the other end of which ends in a neck 4, a free edge 5 of which delimits an opening 6. The exterior surface of the neck 4 has a screw thread 7 capable, as will be seen in greater detail later, of cooperating with a corresponding screw thread (11, FIG. 2A) of a closure 10. In this embodiment, the closure 10 has an internal part 12 arranged inside an outer cover 13. The internal part 12 may be mounted inside the outer covering 13 by bonding, welding or snap-fastening.

The internal part 12 has a transverse wall 14, the edge of which is bent at 90° to form a lateral skirt 15, on the internal surface of which is the screw thread 11. The lateral skirt has two diametrically opposed slots 24, 25 located in the vicinity of the zone where the transverse wall 14 and the lateral skirt 15 meet, and which will be discussed in greater detail later.

Figure 2A:
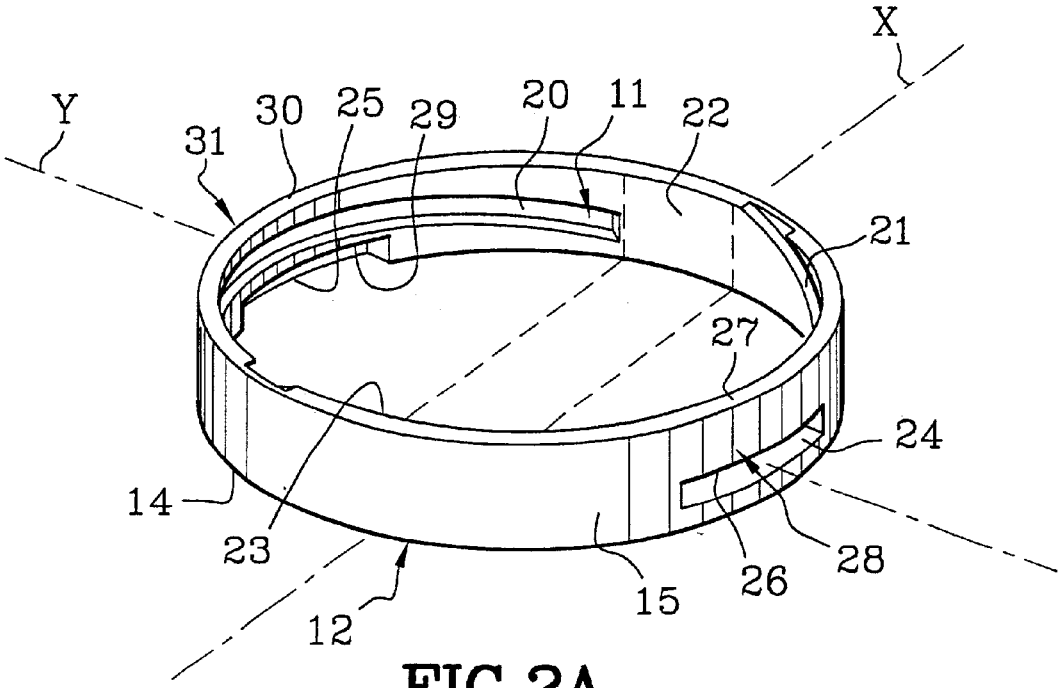
FIGS. 2A–2B depict a detailed view of the closure used with the container of FIG. 1.
Figure 2B:
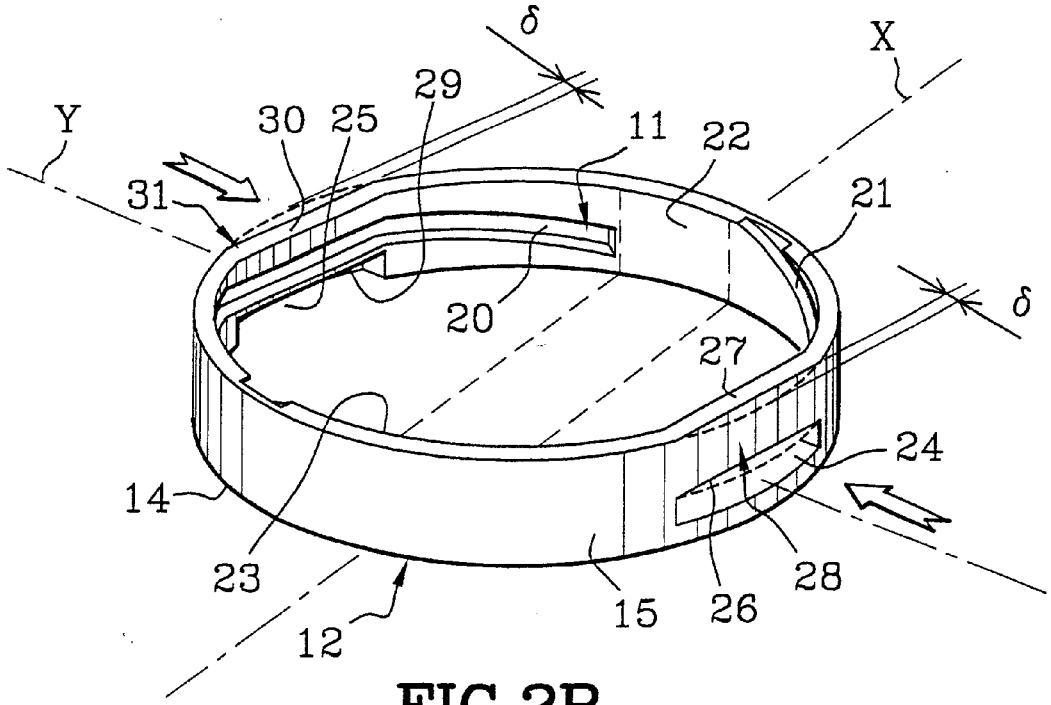

FIGS. 2A and 2B illustrate the part 12 of the closure 10 in greater detail. As mentioned earlier, this part 12 comprises an end wall or transverse wall 14, the edge of which is bent at 90° to form a lateral skirt 15. The internal surface of the lateral skirt 15 bears a screw thread 11, formed of two parts 20, 21 separated by two skirt portions 22, 23 which have no screw thread. The two portions 22, 23 are diametrically opposed and centered on an axis X. The lateral skirt 15 also has two slots 24, 25 passing through the thickness of the skirt 15. The two slots 24, 25 extend parallel to the plane of the end wall 14, and are formed substantially where the end wall 14 and the lateral skirt 15 meet. In the embodiment depicted, the two slots 24, 25 are centered on an axis Y perpendicular to the axis X. Thus, the upper edge 26 of the slot 24 delimits, with the free edge portion 27 of the skirt lying facing the slot 24, a first elastically deformed portion 28. Likewise, the upper edge 29 of the slot 25 delimits, with the free edge portion 30 of the skirt lying facing the slot 25, a second elastically deformed portion 31.

As depicted in FIG. 2B, these two portions 28, 31 are, after release from the mold and after the material has completely cooled, flattened using an appropriate tool, so as to form two diametrically opposed flats. The flattening of these two portions 28, 31 may produce a displacement $\delta$ of material which may range from a few tenths of a mm to several mm. After complete cooling, the two portions 28, 31 are fixed in the position depicted in FIG. 2B. These two portions 28, 31 will allow the part 12 of the closure to elastically grip the neck of the container 1 and to do so in two diametrically opposed zones, thus compensating for any clearance associated with the manufacturing tolerances of the glass screw thread 7 of the container 1. In other words, by virtue of these two flattened portions 28, 31, there are produced two screw thread portions which have a diameter or radius of curvature which differs from the diameter or radius of curvature of the rest of the screw thread 11, thus making it possible, when the part 12 is screwed onto the neck 4 of the container, to achieve a thread-locking effect and thereby ensure that the closure 10 firmly grips the container 1.

Figure 3A:
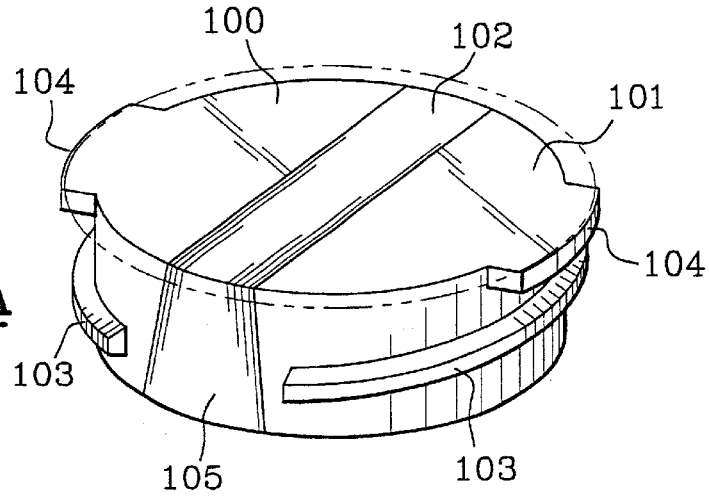
FIGS. 3A–3C depict the main stages in molding/releasing from the mold a closure as depicted in FIGS. 2A and 2B.
Figure 3B:
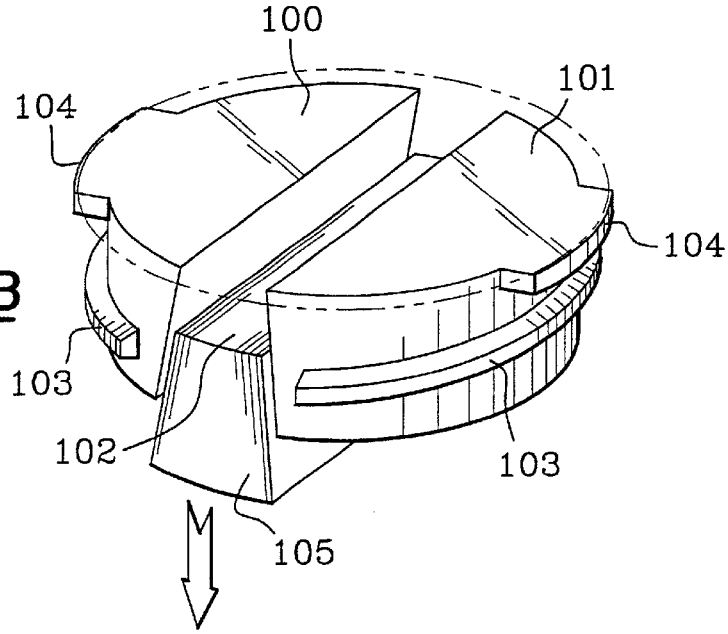
Figure 3C:
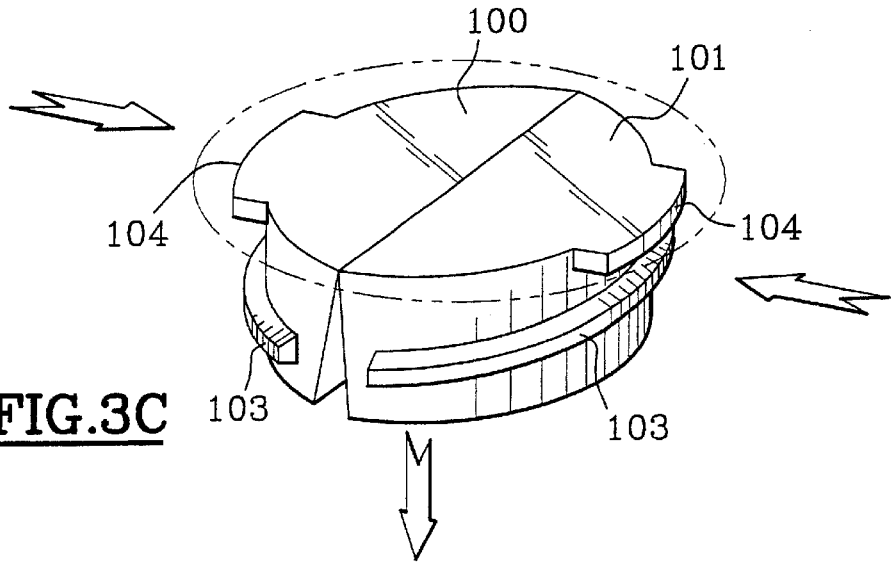

FIGS. 3A–3C illustrate one embodiment of the mold used for producing the portion 12 of the closure depicted in FIGS. 2A and 2B. As is apparent from these Figures, the mold consists of three parts: two lateral parts 100, 101, and a central part 102. Each of the lateral parts has the reliefs 103, 104 needed to produce the portions 20, 21 of the screw thread 11, and to produce the slots 24, 25. The lateral wall 105 of the central part 102 has no reliefs.

After the part 12 has been molded (corresponding to the position of the mold as depicted in FIG. 3A), the central part 102 is retracted as shown in FIG. 3B. Next, as depicted in FIG. 3C, the lateral parts 101, 103 are brought closer together so as to disengage the reliefs 103, 104 from the corresponding recessed parts formed in the molded part, thus allowing the part 12 to be released from the mold. The part 12, as it leaves the mold, is as depicted in FIG. 2A. Before the material cools, the two portions 28 and 31 are flattened in the way depicted in FIG. 2B. The cover 13 is then snap fitted over the part 12.

According to an advantageous alternative, the flattened shape in the region of the two elastically deformed bands 28, 31 is a direct result of molding, by giving the lateral parts 100 and 101 of the mold the corresponding flattened shape. Thus, the part leaves the mold directly with the required shape.

In the foregoing detailed description, reference has been made to preferred embodiments of the invention. It is obvious that variations may be made thereto without departing from the spirit of the invention as claimed hereinafter.

What is claimed is:

1. A closure comprising:

a closure part;

a first screw thread on a lateral skirt of said closure part capable of cooperating with a second screw thread on a container to receive said closure; and at least one bearing part of the lateral skirt at a location such that at least a portion of said first screw thread can bear elastically on the container when said first and second screw threads are engaged, wherein a radius of curvature, at rest, of said at least one bearing part differs from the radius of curvature of the rest of the lateral skirt.

2. The closure according to claim 1, wherein a cross section of said lateral skirt forms at least a part of a circle, and said at least one bearing part is positioned to bear elastically on the container in at least one direction which is oriented radially with respect to the lateral skirt.

3. The closure according to claim 1, wherein said bearing part is positioned to bear elastically on at least one corresponding portion of the second screw thread.

4. The closure according to claim 1, comprising two diametrically opposed bearing parts.

5. The closure according to claim 1, wherein said bearing part comprises at least one flat part of the skirt.

6. The closure according to claim 1, wherein said closure part further comprises a transverse wall, one edge of which is bent at 90° to form said lateral skirt.

7. The closure according to claim 6, wherein said at least one bearing part is delimited at least in part by a slot formed in the lateral skirt.

8. The closure according to claim 7, wherein said skirt comprises two slots situated outside of angular portions which have no screw thread.

9. The closure according to claim 8, wherein said slots are diametrically opposed and centered on an axis perpendicular to another axis on which the two portions which have no screw thread are centered.

10. The closure according to claim 1, wherein said lateral skirt has at least two diametrically opposed angular portions which have no screw thread.

11. The closure according to claim 1, formed of a molded thermoplastic.

12. The closure according to claim 11, wherein the molded thermoplastic comprises one of a polyethylene and a polypropylene.

13. The closure according to claim 1, further comprising an outer covering mounted on the closure part.

14. The closure according to claim 1, wherein said bearing part is a deformed part.

15. The closure according to claim 1, wherein said bearing part has a shape formed during molding.

16. A container comprising:

a container part; and a closure part;

a first screw thread on a lateral skirt of said closure part, capable of cooperating with a second screw thread on the container part; and at least one bearing part of the lateral skirt that bears elastically on the container part when said first and second screw threads are engaged, wherein a radius of curvature, at rest, of said bearing part differs from the radius of curvature of the rest of the lateral skirt.

17. The container according to claim 16, wherein said container part is made of glass.

18. A closure comprising:

a closure part;

a first screw thread on a lateral skirt of said closure part, capable of cooperating with a second screw thread on a container to receive said closure, wherein said lateral skirt comprises at least two diametrically opposed angular portions which have no screw threads; and at least one bearing part of the lateral skirt that can bear elastically on the container, in a direction which is oriented radially with respect to the lateral skirt, when said first screw thread is engaged with the second screw thread of the container, wherein said at least one bearing part extends over a select angular portion of a periphery of said lateral skirt such that said select angular portion can bear elastically on the container, and wherein a portion of said periphery other than said select angular portion will not bear elastically on the container, wherein said at least one bearing part comprises a portion of said first screw thread, and said at least one bearing part does not interrupt said first screw thread.

19. A closure comprising:

a closure part;

a first screw thread on a lateral skirt of said closure part, capable of cooperating with a second screw thread on a container to receive said closure; and at least one bearing part of the lateral skirt that can bear elastically on the container when said first screw thread is engaged with the second screw thread of the container, said at least one bearing part of the lateral skirt being delimited by a slot provided therein.

20. A container comprising:

a container part having an open end;

a closure part;

a first screw thread on a lateral skirt of said closure part, capable of cooperating with a second screw thread on the container part, wherein said lateral skirt comprises at least two diametrically opposed angular portions which have no screw threads; and at least one bearing part of the lateral skirt that bears elastically on the container part, in a direction which is oriented radially with respect to the lateral skirt, when said first and second screw threads are engaged, wherein said at least one bearing part extends over a select angular portion of a periphery of said lateral skirt such that said select angular portion bears elastically on the container, and wherein a portion of said periphery other than said select angular portion does not bear elastically on the container, wherein said at least one bearing part comprises a portion of said first screw thread, and said at least one bearing part does not interrupt said first screw thread.

21. A container comprising:

a container part having an open end; and a closure part;

a first screw thread on a lateral skirt of said closure part, capable of cooperating with a second screw thread on the container part in the vicinity of said open end; and at least one bearing part of the lateral skirt that bears elastically on the container part when said first and second screw threads are engaged, said at least one bearing part of the lateral skirt being delimited by a slot provided therein.

22. A container comprising:

a container part having a neck; and a closure part; and a first screw thread on a lateral skirt of said closure part, capable of cooperating with a second screw thread on the neck of the container part, wherein said closure part defines an inner cross section having a shape different from a shape of an outer cross section defined by said neck so that at least one bearing part of the closure part bears on the container part when said first and second screw threads are engaged, and wherein said at least one bearing part extends over a select angular portion of a periphery of said lateral skirt such that said select angular portion bears elastically on the container, and wherein a portion of said periphery other than said select angular portion does not bear elastically on the container.

* * * * *